United States Patent [19]

Ireland et al.

[11] Patent Number: 4,790,380

[45] Date of Patent: Dec. 13, 1988

[54] WIRELINE WELL TEST APPARATUS AND METHOD

[75] Inventors: Kelly D. Ireland; Robert R. Green, both of Houston, Richard A. Meador; Spring, all of Tex.

[73] Assignee: Baker Hughes Incorporated, Houston, Tex.

[21] Appl. No.: 97,671

[22] Filed: Sep. 17, 1987

[51] Int. Cl.[4] ..... E21B 47/00; G01V 1/40

[52] U.S. Cl. ..... 166/250; 166/66; 175/50; 340/857; 367/82

[58] Field of Search ..... 166/250, 66, 65.1; 175/50; 340/854, 856, 857; 367/81, 82; 439/296

[56] References Cited

U.S. PATENT DOCUMENTS

| | | | |
|---|---|---|---|
| 3,090,031 | 5/1963 | Lord | 340/18 |
| 3,186,222 | 6/1965 | Martin | 73/151 |
| 3,227,973 | 1/1966 | Gray | 333/78 |
| 3,879,097 | 4/1975 | Oertle | 339/16 R |
| 3,991,611 | 11/1976 | Marshall, III | 340/857 |
| 4,108,243 | 8/1978 | King et al. | 166/66 |
| 4,178,579 | 12/1979 | McGibbeny et al. | 340/857 |
| 4,348,672 | 9/1982 | Givier | 340/854 |
| 4,510,797 | 4/1985 | Guidry et al. | 166/250 |
| 4,541,481 | 9/1985 | Lancaster | 340/856 |
| 4,605,268 | 8/1986 | Meador | 339/16 C |
| 4,678,035 | 7/1987 | Goldschild | 166/250 |

OTHER PUBLICATIONS

Flopetrol literature—pp. 184–187 and 190–194.
Flopetrol literature—5 unnumbered pages.
Halliburton SRO System—4 page undated brochure.

*Primary Examiner*—Jerome W. Massie, IV
*Assistant Examiner*—Terry Lee Melius
*Attorney, Agent, or Firm*—Hubbard, Thurman, Turner & Tucker

[57] ABSTRACT

An improved technique for monitoring subterranean formation test data is provided utilizing an electric wireline to transmit data in real time from sensors positioned downhole in a test string to surface computing and readout equipment. The electrical connection between the downhole sensor and the wireline is made by a current coupler technique which reliably allows for transmission of signals representative of downhole test parameters, with the transmitted signals being insensitive to the presence or conductivity of the well fluids. A transmitter/receiver coupler half is carried in the well via conductor wireline on a latch tool for coupled electrical engagement with a mating receiver/transmitter coupler half contained in a downhole landing receptacle. The latch tool may be electrically activated to mechanically latch and electronically or mechanically activated to unlatch from the landing receptacle, so that a full bore passage is provided through the landing receptacle when the latch tool is not interconnected with the landing receptacle. Two-way data transmission is possible, so that downhole instrumentation and equipment can be activated from the surface via control signals transmitted through the coupler device, and data from downhole sensors can be transmitted in real time to surface computing and recording equipment.

25 Claims, 4 Drawing Sheets

WIRELINE WELL TEST APPARATUS AND METHOD

FIELD OF THE INVENTION

The present invention relates to techniques for transmitting information in real time from downhole instrumentation and equipment in a well bore to surface readout equipment and, more particularly, to techniques for transmitting downhole well test data during well testing operations utilizing a conductor wireline.

BACKGROUND OF THE INVENTION

Well testing techniques have long been used in petroleum recovery operations for testing characteristics of a selected formation and the fluid in that formation. Well test equipment thus typically includes a ball valve or flapper valve carried downhole on the test string so that the flow path may be selectively opened and closed to allow fluid to pass from the formation, through the casing perforations or open hole, through the valve, and into the test string. According to one technique, the formation fluid may flow through the valve to the surface for sampling, although more recent techniques do not require sufficient formation pressure to force formation fluid to the surface through the valve.

Geologists have long recognized that a significant amount of valuable information regarding formation characteristics can be obtained by analyzing pressure, temperature, flow rates, and composition taken under reservoir conditions in a well bore below a valve which is controllably opened and closed. By selectively modifying the duration of "shut-in" and "flow" periods while monitoring these parameters below the valve, geologists can perform buildup and drawndown analyses under reservoir conditions, thereby providing useful information regarding the anticipated productivity of the formation.

Prior art testing techniques allowed for the storage of data indicative of downhole conditions, so that this data could subsequently be retrieved to the surface with other downhole equipment and then analyzed to determine useful information. Preferred test monitoring techniques today, however, allow for the transmission of downhole data to the surface for analysis during "real time", i.e., data is transmitted from a downhole sensor to the surface almost instantaneously, so that the testing operation itself can be adjusted based upon the information obtained. Real time testing data transmission techniques, for example, thus enable the number and time duration of shut in and flow periods to be adjusted based upon information transmitted and evaluated at the surface during the test and essentially instantaneous with the generation of that information by the downhole sensors.

Certain prior art test equipment monitors pressure and temperature conditions utilizing sensors which are lowered into the well bore on a wireline rather than being run in with the downhole DST tools. This type of DST monitoring technique, such a Halliburton's E-Latch system and Flopetrol's Must system, require that a pressure seal be established between the downhole test equipment and the sensor and related equipment which are lowered into the well bore via the wireline. Effecting a seal between downhole equipment and wireline equipment containing pressure and temperature sensors can be unreliable. A passageway may be provided around the test valve for fluid communication with a mating passageway in the wireline lowered equipment containing the sensors, but the downhole passage must then be closed off to prevent fluid flow around the valve when the wireline equipment and sensors are returned to the surface. Accordingly, equipment of this type has not been widely accepted in the petroleum recovery industry.

Flopetrol's DataLatch system has full bore capability and utilizes test sensors positioned downhole with the test valve and related equipment. This technique is typical, however, of prior art techniques which utilize an electrical "wet connection" between the downhole sensor and the wireline for data transmission. A downhole wet connection is an electrical connection which is ideally kept "dry" by a covering, such as an elastomeric boot, which fits around the physically mated electrical connectors. A wet connection ideally isolates the downhole well fluids from the connector, and hopefully the well fluids thus do not significantly affect the accuracy and reliability of the data signal being transmitted across the connection. In practice, however, this type of connection is not dry and the transmitted data may be significantly affected by the presence and type of well fluid. The reliability of the transmitted data is thus poor, and it is often difficult and time consuming to determine if and when the desired electrical connection has been made due to alignment and connection problems associated with the boot.

The DataLatch system also utilizes a complex technique for mechanically latching the downhole equipment and the wireline lowered equipment. The technique basically requires selective tension or slack manipulation of the wireline for latching the components and operating the system. Such "pull and slack" wireline operations are time consuming and generally considered unreliable. Moreover, wireline manipulation operations which require that tension be maintained on the wireline are difficult or impossible to perform during certain types of petroleum recovery operations, e.g., when working from a floating vessel.

Other well test equipment, such as Flopetrol's Spro system, does not provide full bore testing capability, and thus has the disadvantages previously mentioned with respect to restriction of the flow path for both fluid flow and wireline tools. Moreover, the Spro system has many of the additional disadvantages of Flopetrol's DataLatch system, including the disadvantages associated with the wet connection and with wireline pull and slack manipulations.

The disadvantages of the prior art are overcome by the present invention, and improved methods and apparatus are hereinafter described for reliably transmitting downhole testing information by a conductor wireline to surface manipulation and recordal equipment.

SUMMARY OF THE INVENTION

Improved techniques are provided for increasing the reliability of transmitting data from downhole sensors, such as pressure sensors, temperature sensors, and other sensors generally associated with testing operations, to surface recordation, computing, and readout equipment. A current coupling device is utilized to reliably transmit electrical signals having a characteristic representative of data generated by downhole sensors to an electrical wireline selectively positioned in the well bore. Accordingly, a downhole half of the current coupler is electrically in physical contact with the downhole sensors, and a wireline half of the coupler is electrically in physical contact with the electrical wireline. When coupled, two-way communication in real time is provided, so that downhole data may be transmitted to the surface, and power and command signals may be transmitted from the surface to downhole equipment.

According to one embodiment of the invention, a test valve, a carrier with sensors, and a landing recepticle with an annular coupler half are provided as downhole equipment run into the well. A plurality of sensors for monitoring reservoir parameters are thus provided in the test string. The sensors may be positioned physically above the ball valve by providing a media passageway from below to above, or "around", the valve for connecting these sensors to reservoir parameter conditions below the valve A latch tool carrying the wireline coupler half is run into the well on a conventional conductor wireline. Computing, recordation, transmission and printout devices are provided at the surface for receipt and processing of the transmitted data.

The wireline latch tool may be selectively connected to and disconnected from the landing recepticle by electrical signals initiated at the surface. When properly positioned within the recepticle, the latch members may be activated by a command signal from the surface, and a response signal provides assurances that the latch members have been properly secured within the recepticle. The latch tool may similarly be disconnected from the recepticle by an unlatch signal to driving means for the latch members, and the latch tool then retrieved to the surface. Should the latch members fail to unlatch, a shearing mechanism connecting the latch members and the latch tool may be severed by pulling on the wireline, thereby still allowing for retrieval of the latch tool.

The techniques of the present invention thus allow for reliable real time transmission of well test data to surface equipment during well testing conditions. Power may also be transmitted from the surface through the coupler device to the sensors or other downhole equipment. The sensors are run in with the downhole tools, thereby obviating the difficulty of obtaining a fluid-tight seal between the test tools and wireline-carried sensors. When the latch tool is not connected to the recepticle, a full bore opening is provided in the tool string for facilitating other conventional downhole operations. The pressure across the valve need not be equalized prior to opening of the valve. The electromechanical operation of the latch tool/landing recepticle connection increases reliability and avoids problems associated with wireline pull/slack operations to connect and disconnect downhole equipment. Most importantly, the current coupler device utilized between the sensor and the conductor wireline avoids the reliability and operational problems associated with other types of electrical connections.

It is thus an object of the present invention to provide a reliable technique for transmitting data from downhole sensors to the surface utilizing a conductor wireline, with the signal being transmitted through a current coupling device. It is a further object of the invention to provide such a data transmission technique which is substantially insensitive to the presence or conductivity of the well fluids. Still another object of the invention is a comparatively simple and inexpensive system, which does not require numerous amplifiers, relays, and related electronics, for effecting the reliable transmission of downhole test data to surface equipment.

These and further features and advantages of the present invention will become apparent from the following detailed description, wherein reference is made to the figures in the accompanying drawings.

DETAILED DESCRIPTION OF PREFERRED EMBODIMENTS

Figure 1A:
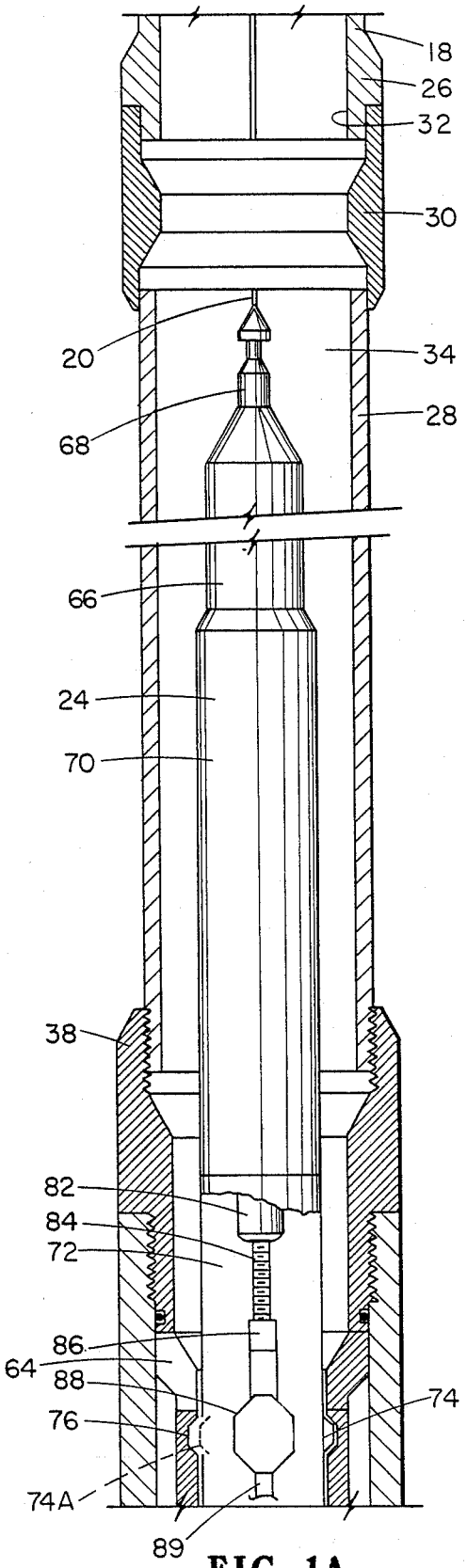
FIG. 1A and 1B are side elevations, partially in cross-section of downhole test equipment and connected conductor wireline equipment according to the present invention for real time transmission of information to the surface.
Figure 1B:
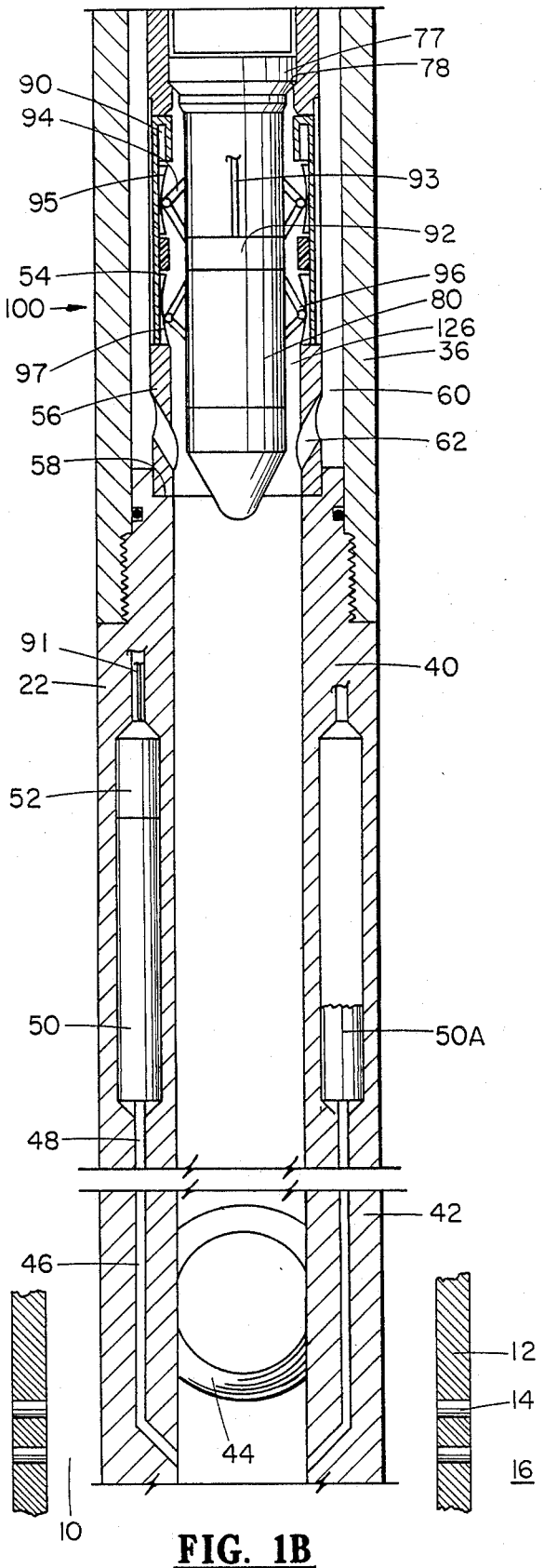

Referring to FIG. 1, the teachings of the present invention may be understood with reference to the transmission of data during a well test operation of a subterranean recovery well. Accordingly, those skilled in the art recognize that the downhole tools of the present invention may be positioned in a well bore 10 defined by either an open hole or a well casing 12 which includes a plurality of perforations 14 allowing fluid communication between the well bore and oil or gas bearing formation 16. The teachings of the present invention may be utilized to transmit to the surface in real time indications of formation parameters in the well bore 10, so that conventional testing analyses can be used to determine the characteristics of formation 16.

The apparatus shown in FIG. 1 includes downhole tools which can be run into the well on a test string 18 which typically extends to the surface, and wireline tools which may be intermittently run into the well through the interior of the test string on a conventional electric wireline 20. The tubular string 18 may be a drill string, a work string, a completion string, or any other type of tubular string capable of performing a well test. The downhole tool assembly 22 is thus physically a part of the test string 18 and is relatively permanently fixed downhole in the well, while the wireline tool assembly 24 may be quickly and relatively inexpensively run into and out of the well bore on wireline 20.

The test string 18 includes tubular lengths typically connected by a pin and box arrangement. As shown in FIG. 1, the pin end 26 of a tubular length is threadably connected to tubular 28 by coupling 30 or by other conventional connection means. The assembly 22 of the present invention when positioned permanently downhole as part of the test string need not restrict the central passageway 34 of the test string, and accordingly allows for "full bore" operations.

Tubular 28 may be connected to landing recepticle housing 36 in a fluid-tight manner by connection 38. Housing 36 is similarly threaded to carrier housing 40, which in turn is connected to valve assembly 42 having a ball valve 44 which may be selectively opened or closed in a conventional manner. Regulation of ball valve 44 thus opens or closes the fluids in the formation 16 to the interior of the passageway 34, thereby controlling the buildup or drawdown conditions previously described.

Valve assembly 42 is provided with one or more passageways 46 for transmitting fluid pressure "around" the ball valve, i.e., for allowing fluid pressure from below the closed ball valve 44 to be transmitted to a point above the ball valve. Passageway 46 is sealingly in fluid communication with a similar passageway 48 in the carrier housing, so that downhole fluid below ball 44 is subjected to the pressure and temperature sensor 50 above the ball. Multiple sensors 50 may be provided for redundancy, or for sensing different downhole characteristics, and accordingly sensor 50A should be understood as a backup or redundant sensor. Electronic package 52 associated with sensor 50 includes a power supply, a demodulator, and a modulator described subsequently. Sensor 50 and electronic package 52 may be conventional sensors of the type normally used to monitor test parameters.

Landing recepticle housing 36 receives a conductive sleeve 54 radially and axially fixed within housing 36, with a lower end 56 of connection 38 engaging a stop surface 58 on housing 40. A sleeve-configured fluid passageway 60 is thus provided between housing 36 and the lower end 56 of connection 38 carrying the sleeve 54, and is connected with the interior passage of housing 40 (and with the formation 16 when ball 44 is open) by one or more ports 62 in lower end portion 56. Staggered passageways 64 similarly provide fluid communication between passageway 60 and interior passageway 34 of the test string. Fluid from the formation 16 may thus pass into the test string interior when the ball 44 is open, even if the wireline tool assembly 24 is positioned as shown in FIG. 1. Moreover, the test string may retain a full bore capability, due to the sizable diameter of both the sleeve 54 and the lower end 56 of connection 38.

Conventional electric line sinker bar 66 is connected to the end of wireline 20 by standard connector 68. An upper wireline sleeve-shaped housing 70 protects a power supply, a modulator, a demodulator, and a line driver described subsequently. A lower wireline sleeve-shaped locking housing 72 is positioned below housing 70 and includes a plurality of radially dogs or latching members 74. Shoulder portion 77 is adapted for engagement with stop surface 78 on lower end 56 for limiting axial movement of wireline tool assembly 24, and connects housing 72 with the tip end sleeve-like noze portion 80.

Housing 72 includes a small electrically powered motor 82 which regulatably rotates threaded shaft 84 for axially moving coupling 86 in a conventional manner to properly position cam surfaces 88 relative to motor 82. Latching members 74 are driven radially outwardly-into slot 76 of-portion 56 by cam surfaces 88 to axially interlock housing 72 and thus wireline tool assembly 24 with connector 38 and thus downhole tool assembly 22 upon actuation of motor 82.

A toroidal downhole coupling half 90 comprising a toroidal magnetic core and wire windings is carried in metallic sleeve 54 as shown, and is electronically connected to sensor 50 or 50A by insulated wire 91 and conventional pressure resistant electrical connectors. Positioned radially inwardly of coupling half 90 is a similar toroidal wireline coupling half 92, comprising a toroidal magnetic core and a wire winding suitably insulated and positioned in noze portion 80 as shown, such that coupling half 92 is axially aligned with coupling half 90. Coupling half 92 is electronically connected to the wireline 20 by an insulated wire 93 provided in a pressure shielded passageway through the wireline tool assembly 24. Wireline 20 thus transmits signals from the surface to the apparatus shown in FIG. 1 and from the apparatus shown in FIG. 1 to the surface. A plurality of upper flexible or hinged contacts 94 and a plurality of lower electrical contacts 96 move radially to engage respective cages 95 and 97 in response to activation of motor 82 as described above. Accordingly, it should be understood that shaft extension 89 passes through the noze portion 80 and moves axially to radially move contacts 94 and 96 into and out of electrical engagement with cages 95, 97. Coupling halves 90 and 92, contacts 94 and 96, conductive sleeve portion 55 54 and conductive cages 95, 97 together form a current coupler 100 for reliably transmitting data from the sensors 50 or 50A to the electronics in 70 and ultimately to wireline 20, as described hereafter.

Figure 2:
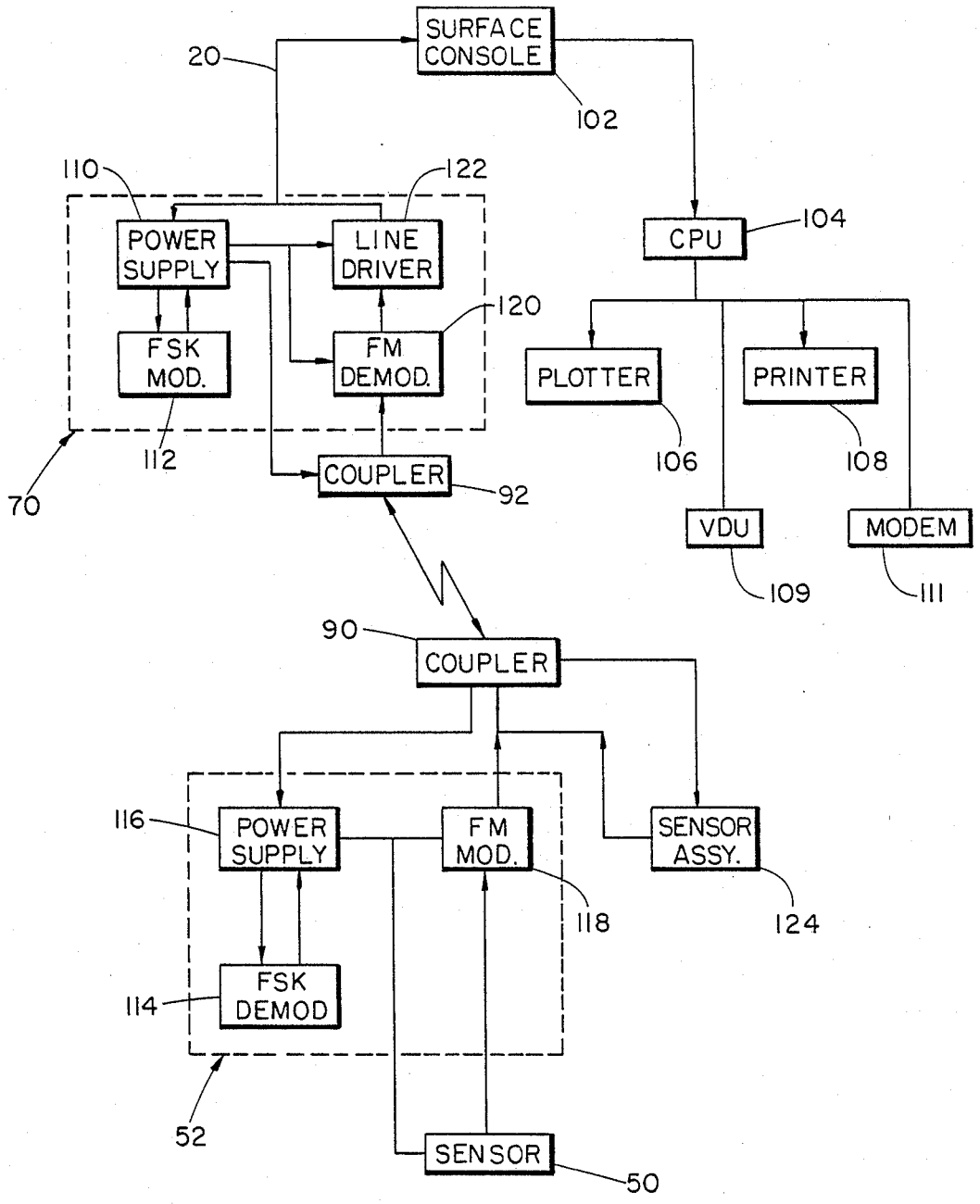
FIG. 2 is a block diagram of a portion of the equipment shown in FIG. 1 along with suitable surface equipment.

As shown in FIG. 2, a simplified block diagram of the electronic components within the apparatus shown in FIG. 1 is depicted. Equipment maintained at the surface includes a console 102 for operator interaction and control, which is coupled to a computer or central processing unit 104 for storage and processing of data. Data representative of sensed downhole conditions may thus be stored, filtered, modified or otherwise processed in a conventional manner, and signals representative of sensed data may thus be visually shown on plotter 106 or retained from a hard copy produced by printer 108 or other peripherals. A suitable central processing unit 104 may be coupled with other computers suitable for driving plotters 106, printers 108, video display units 109, modems 111, or other peripheral devices. Available software for the CPU 104 includes the SRO Master Menu and the Plot Master software, as well as other applications software.

The surface console 102 is shown electronically connected to the conductor wireline electronic package within housing 70 by wireline 20, although a standard hard-wire connection in a pressure shielded passageway would generally be used between wireline 20 and the electronics within housing 70, and between that electronics and coupler half 92. The wireline tool assembly 24 preferably includes its own power supply 110, which is connected to a frequency shift keyed modulator 112. Modulator 112 thus generates one or more frequency-keyed power signals in response to a command signal from the surface console 102, which are then transmitted through coupler half 92 and thus coupler half 90. A complimentary demodulator 114 in the downhole electronics package 52 is responsive to a preselected power frequency signal from power supply 110, e.g., a 5 kHz signal, while another demodulator (perhaps for activating another sensor) may be responsive to a signal of, e.g., 6 kHz transmitted through the coupler.

A separate power supply 116 may be provided within the downhole electronics package 52 for powering the demodulator 114, the sensor 50, and the FM modulator 118. A signal from the sensor 50 having a characteristic, such as amplitude, representative of a monitored condition, such as downhole temperature or pressure, may thus be converted by 118 to a frequency signal representative of the monitored condition and suitable for transmission across the current coupler 100. The carrier frequency from the FM modulator is substantially different than the power signal from the modulator 112, and typically may be in the range of 500 kHz, with a band width suitable for the sensors employed. A typical 501 kHz signal passing through the coupler may thus be representative of a certain downhole monitored pressure, and will be converted by demodulator 120 to a 1 kHz signal, which may then be amplified by line drive 122 for transmission through the conventional wireline to computer 104. Sensor assembly 124 is shown in parallel with electronics package 52 and sensor 50, and comprises a sensor 50A and a backup electronics package 52 for redundancy. As explained further below, any desire number of sensors for monitoring various well test parameters may be provided in the carrier housing 40.

Referring again to FIG. 1 and particularly the current coupler 100 of the present invention, it should be understood that a signal having a characteristic representative of a downhole sensed condition monitored by sensor 50 will be transmitted through hard wire 91 to coupling half 90. This representative signal typically has a low current value which produces a varying electro-magnetic field substantially defined within portion 55 of conductive sleeve 54 radially inward of coupling half 90. This varying field generated about coupler half 90 will cause current to flow in a current loop through conductive sleeve 54, through cage 95, through members 94, through conductive nose portion 80, through members 96, through cage 97, and back to conductive sleeve 54. This current flow through the noze portion 80, in turn, induces a corresponding signal in coupler half 92 which fully retains the characteristics of the signal representative of the monitored condition.

The current coupler 100 of the present invention thus includes two toroidal coils 90 and 92 which are not in direct ohmic contact, but rather are effectively electrically insulated from each other, and are indirectly connected through the current loop described. Each toroidal coil 90 and 92 includes a core wound in a conventional manner with a wire electrically connected to wire 91 and 93, respectively. The concept of the present invention allows for the reliable transmission of signals through the respective conductive members 54 and 80 adjacent coils 90 and 92, and through the mechanical and electrical interconnections provided by members 94 and 96 between members 54 and 80. The current coupler of the present invention is thus operationally similar to the current coupler described in U.S. Pat. No. 4,605,268, which relates to techniques for communicating signals through interconnected pipe sections in order to perform logging while drilling operations.

The current coupler 100 of the present invention thus provides for the reliable transmission of data from sensors 50 to wireline 20 without being influenced by the presence or type of well fluid in the well bore. Well fluid in gap 126 between coupling halves 90 and 92 will thus have virtually no affect of the reliability or accuracy of transmitted data according to the present invention, even though such well fluids, which may be electrically conductive, are in direct physical contact with conductive members 54, 95, 94, 80, 96, and 97.

As previously mentioned, the concept of the present invention allows for two-way transmission of signals: command signals from the surface may be transmitted to downhole equipment through the current coupler, and downhole data signals may be transmitted through the current coupler to surface equipment. Thus each coupler half 90 and 92 may be considered both a transmitter of signals to the other coupler and a receiver of signals from the other coupler. Command signals may thus be "downlinked" through the coupler 100 to control downhole operations, e.g., to turn one or more sensors off while activating other sensors, while data is subsequently "uplinked" from the downhole sensor to the surface. Also, signals from multiple sensors may be successfully passed through the coupler 100, each signal having its characteristic carrier frequency or time slot utilizing conventional frequency, time, duration, phase, pulse or amplitude multiplexing techniques.

According to the method of the present invention, the downhole tool assembly 22 may be assembled at the surface, connected to a tubular test string length, and run in to a cased or uncased well bore in a conventional manner. Full bore capability of the test tools are maintained. In order to run a real time well test, the wireline tool assembly 24 may be lowered into the well on a conventional conductor wireline. When the assembly 24 is properly positioned axially with respect to assembly 22, motor 82 may be activated by passing a control signal down wireline 20. Activation of motor 82 will cause latch members 74 to move radially outwardly, locking assemblied 22 and 24 together. Continued activation of motor 82 will thereafter similarly cause members 94 and 96 to move radially outwardly to mechanically and electrically interconnect members 54 and 80 having coupling halves 90 and 92 respectively mounted thereon.

With the wireline tool assembly properly latched to the downhole tool assembly, monitored data may be transmitted in real time to the surface. The ball valve 44 may be repeatedly opened and closed according to conventional technology, and buildup and drawdown characteristics of the formation monitored. The number and duration of well shut in and flow periods may be adjusted during the well test since data is obtained, processed, and studied at the surface in real time. If desired, various control signals may be downlinked through the current coupler 100 to activate or deactivate different sensors, or to perform other downhole operations. After a desired number of tests have been conducted, the motor may again be activated to unlatch the wireline assembly 24 from the downhole assembly 22, and the wireline assembly then retrieved to the surface by conductor 20.

Figure 3:
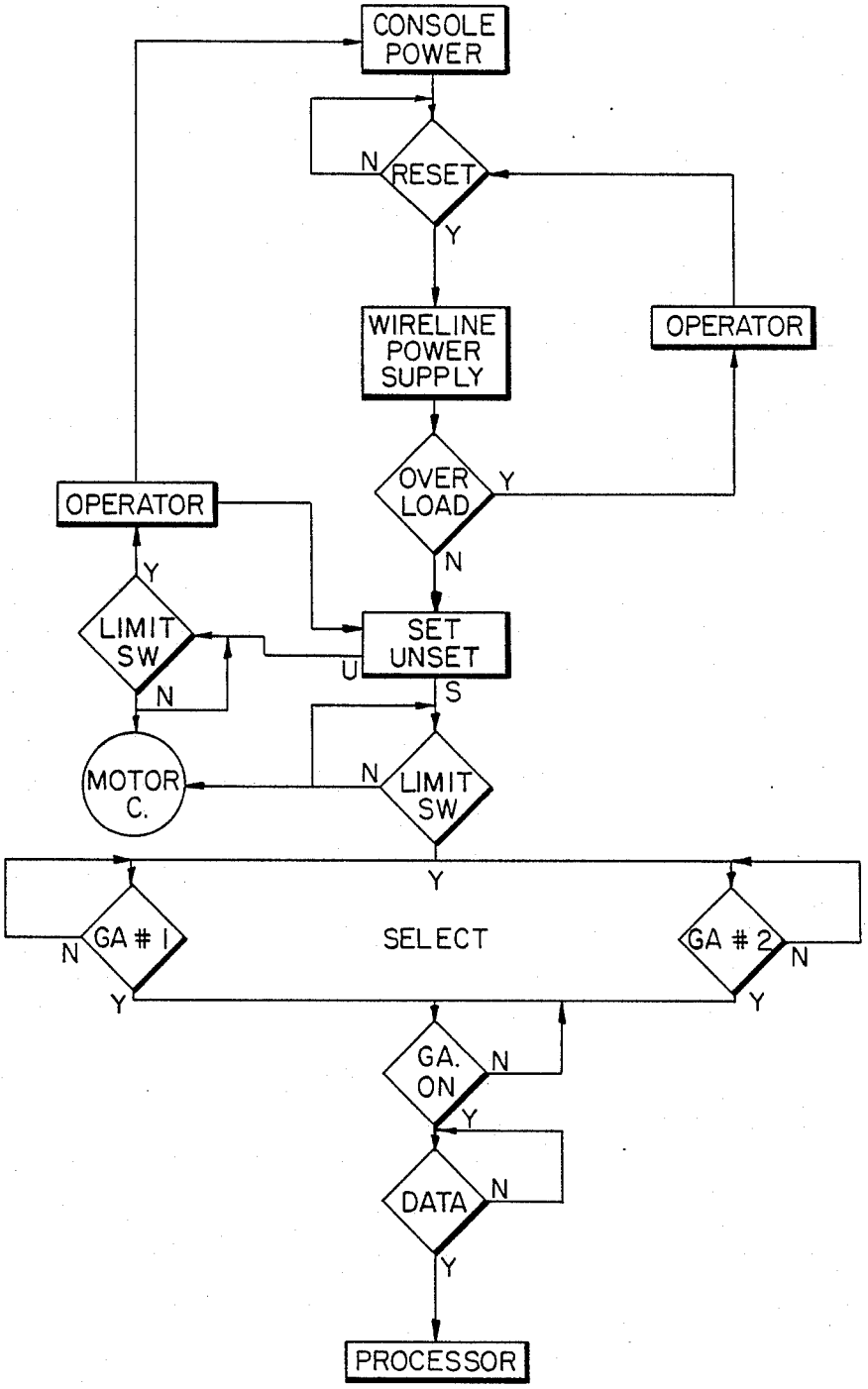
FIG. 3 is a flow diagram of the operational logic associated with the equipment represented in FIG. 2.

FIG. 3 depicts in block form a logic diagram for operating equipment shown in FIG. 1. Console power may be activated or reactivated by a reset to energize the power supply in the wireline tool assembly. The operator may actuate a control switch to cause motor 82 to turn on. If the wireline tool assembly is properly positioned with respect to the downhole tool assembly, the latch members move radially outward and the assemblies will become latched, thereby activating the set limit switch. If the wireline tool assembly is not properly positioned axially with respect to the downhole tool assembly, overload switch may be triggered before the set limit switch, or the absence of data will cause operator interaction. The operator may then reactivate the setting or unsetting motor and reposition the wireline tool assembly with respect to the downhole tool assembly.

Once the wireline tool assembly has been properly positioned and the set limit switch has been activated, the operator may select any of numerous downhole sensors for monitoring. With the appropriate sensor on, data will be transmitted to the surface through the current coupler 100. Should sensor Number 1 fail, sensor Number 2 may be selected by a suitable control signal passing from the surface through the current coupler 100. If desired, various downhole operations may also be performed by passing similar suitable control signals from the surface through the current coupler to downhole equipment. Once the test has been completed and the desired data obtained at the surface, another control signal may be passed to the motor to unset the wireline tool assembly from the downhole tool assembly. Once the unset limit switch comes on, the wireline tool assembly may be retrieved to the surface.

In the event that the latch tool did not unlatch from the landing recepticle in response to electrical actuation of the motor, a backup shear mechanism is provided for retracting the latch members to their unlock position. This shear means may be activated by straight pull force applied to the electric line 20, which shears pins (not shown) so that the shaft 89 automatically moves upward to free the latch members 74 and thus allows the removal of the wireline assembly.

Figure 4:
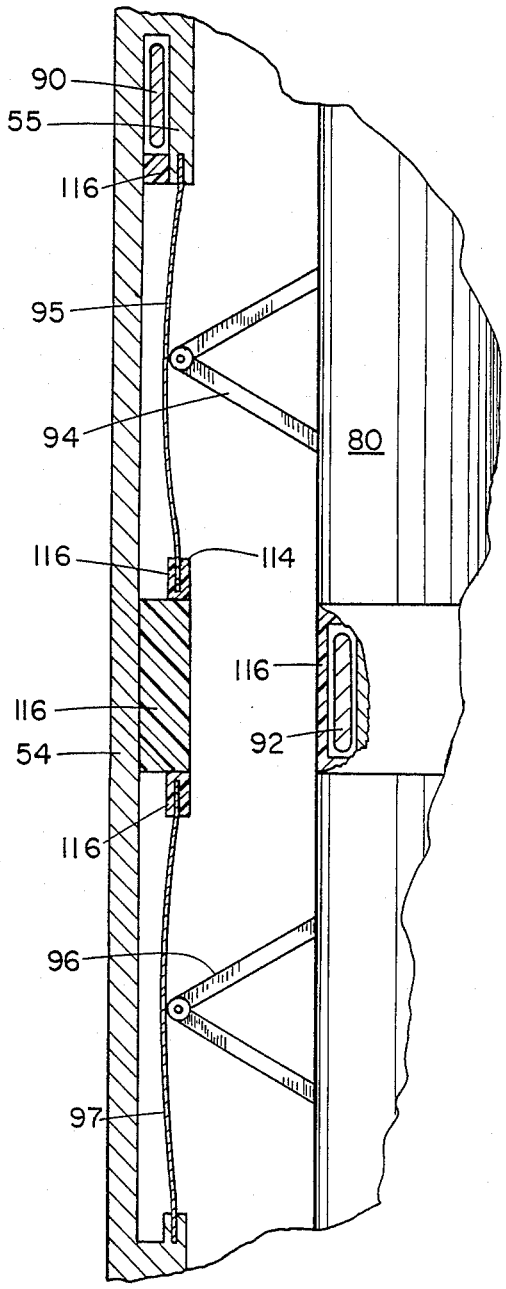
FIG. 4 is a side elevation, partially in cross-section, of a portion of the equipment shown in FIG. 2.

Referring now to FIG. 4, further details regarding components of the apparatus shown in FIG. 1 are depicted. The elements 94 and 96 which establish electrical communication between conductive members 54 and 80 provide the completed current loop by engaging flexible cages 95 and 97, respectively. Each cage may be fabricated from sheet spring steel shaped to a sleeve-like configuration, with multiple vertical slots (not depicted) to better allow vertical strips between the slots to flex radially outward when elements 94, 96 move outward. Latch members 74 may allow for limited, e.g., less than ~", axial movement of the assemblies 22 and 24, and the construction of cages 95 and 97 thus coperates with 94 and 96 to ensure that a sound mechanical and thus electrical engagement exists for forming the current loop even if the members 94, 96 move slightly axially along respective members 95, 97. Appropriate connectors 114 and insulators 116 are provided for establishing electrical communication between conductive sleeve 54 and cages 95, 97. FIG. 4 also depicts conductive portion 55 of sleeve 54 spaced radially inward of coupler half 90 for effecting the electromagnetic field and thus achieving the current coupler technique.

Unlike magnetic couplers which are highly sensitive to axial movement of one coupler half relative to the corresponding coupler half, the current coupler concept of the present invention allows for axial movement of coupler halves without influencing the reliability or accuracy of the signals transmitted through the coupler. Although the coupler halves 90 and 92 are shown positioned axially at approximately the same level, the coupler halves may be spaced axially a considerable distance from each other without affecting reliability to accomodate construction of the tools, e.g., coupler half 92 could be positioned axially above members 94. Thus a current loop through components 54, 95, 94, 80, 96, 97 and 54 establishes the necessary electrical flow path, although such an electrical flow path may be obtained utilizing conventional conductors and insulators even when coupler half 92 is axially separated considerable distance from coupler half 90.

The apparatus of the present invention is sufficiently rugged for severe downhole temperature, pressure, and operating conditions. Typical apparatus according to the present invention, as shown in FIG. 1 may have a working pressure in excess of 10,000 psi, a working temperature in excess of 350° F., and tensile strengths of 350,000 pounds.

In the embodiment described above, hydraulic passageways were used to transmit fluid pressure "around" the ball, since the sensors may be positioned physically above the ball. In an alternative embodiment, the sensors could be provided below the ball, and hard wires used to transmit signals from the sensor to the current coupler positioned above the ball. Also, although the wireline tool assembly and the downhole tool assembly have each been described above to include their own power supply, those skilled in the art will readily appreciate that power to either or all of these assemblies may be supplied from the surface through the wireline to the downhole equipment, or from batteries positioned downhole.

Although the invention as described herein has been particularly described with respect to sensors capable of measuring downhole pressure and temperature, the techniques of the present invention are equally applicable to transmitting downhole signals to the surface indicative of any number of including but not limited to formation porosity, fluid flow rate, fluid capacitance, etc. Also, the concepts of the present invention may be used to reliably transmit any type of downhole signal from a sensor for transmission through the current coupler of the invention.

Although the invention has been described in terms of the specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Apparatus for monitoring well fluid characteristics during a subterranean well test utilizing a test string positioned in a subterranean well bore in fluid communication with a formation of interest, the test string including a central passageway for lowering wireline tools to a selected test string depth via a conductor wireline, the apparatus comprising:

a test valve positioned on the test string;

a sensor means positioned on the test string for sensing well fluid characteristics below the test valve and generating a first signal functionally related to a sensed characteristic;

a landing receptacle means positioned on the test string axially above the test valve;

converter means positioned on the test string functionally related to the first signal;

generating means positioned on the test string for inducing a fluctuating electromagnetic field within, an electrically conductive portion of the landing receptacle means adjacent the generator means in response to the second AC signal;

latch tool means carried by the wireline and positionable within the central passageway of the test string for temporarily latching in a fixed axial position on the landing receptacle;

receiver means carried by the latch tool means adjacent an electrically conductive portion of the latch tool means and spaced radially inward of and in ohmic isolation from the generating means when said latch tool means is temporarily latched in said landing receptacle means for providing a third signal induced by the fluctuating electromagnetic field and having a characteristic proportional thereto;

signal conditioning means carried by the wireline for amplifying and converting the third signal for transmission to the surface via the electric wireline; and computer means at the surface for analysis of the converted signal in real time.

2. The apparatus as defined in claim 1, further comprising:

a flow path radially exterior of the generating means for passage of well fluids from the formation to the central passageway of the test string above the generator means when the latch means is axially positioned on the landing receptacle and the test valve is in an open position.

3. The apparatus as defined in claim 1, further comprising:

a first radially movable conductive interconnection means for establishing a mechanical and ohmic electrical path between the conductive portion of the landing receptacle means and the conductive portion of the latch tool means while the latch tool means is positioned on the landing receptacle; and a second radially movable conductive interconnection means for establishing a mechanical and ohmic electrical path between the conductive portion of the latch tool means and the conductive portion of the landing receptacle means while the latch tool means is positioned on the landing receptacle;

such that a current loop is formed between the conductive portion of the landing receptacle means, the first conductive interconnection means, the conductive portion of the latch tool means, and the second conductive interconnection means.

4. The apparatus as defined in claim 3, further comprising:

a first electrically conductive radially flexible cage positioned on the test string and electrically connected to the conductive portion of the landing receptacle for engagement with the first conductive interconnection means;

a second electrically conductive flexible cage positioned on the test string and electrically connected to the conductive portion of the landing receptacle for engagement with the second conductive interconnection means; and the first and second conductive interconnection means are carried into the well on the latch tool means.

5. The apparatus as defined in claim 4, further comprising:

electrically powered drive means carried by the wireline for moving the first and second conductive interconnection means into electrical contact with the first and second cages, respectively.

6. The apparatus as defined in claim 1, further comprising:

latch member means carried in the well on the latch tool means for moving radially into latched engagement with the landing receptacle; and electrically powered drive means carried into the well on the wireline for causing radial movement of the latch member means.

7. The apparatus as defined in claim 1, further comprising:

the sensor means being positioned axially above the test valve; and a fluid pressure passageway in the test string for establishing a pressure communication between the central passageway of the test string below the test valve to the sensor means above test valve.

8. The apparatus as defined in claim 1, further comprising:

a second sensor means positioned on the drill string for sensing well fluid characteristics below the test valve; and surface controlled selection means for activating or deactivating the first sensor means and the second sensor means.

9. Apparatus for generating downhole data from sensors fixedly positioned on a tubular string in a subterranean well bore, the tubular string including a central passageway for lowering wireline tools to a selected depth via a conductor wireline, the apparatus comprising:

surface computing equipment for processing of the downhole data in real time;

surface readout equipment for operator readout of the downhole data;

surface control equipment for generating control signals in response to the downhole data;

sensor means positioned on the tubular string for sensing downhole characteristics and generating a first signal functionally related to a sensed characteristic;

landing receptacle means positioned on the tubular string;

generator means positioned on the tubular string for inducing a fluctuating electromagnetic field in response to the first signal;

latch tool means carried by the wireline and positionable within the central passageway of the tubular string for temporarily latching in a fixed axial position on the landing receptacle means;

receiver means carried by the wireline means and in ohmic isolation from said generator means when said latch tool means is temporarily latched in said landing receptacle means for producing a second signal induced by the fluctuating electromagnetic field and having a characteristic proportional thereto; and signal conditioning means carried by the wireline for amplifying and converting the second signal for transmission to the surface computing equipment via the conductor wireline.

10. The apparatus as defined in claim 9, further comprising:

a fluid pressure passageway in the tubular string for establishing pressure communication between the central passageway of the tubular string and the sensor means.

11. The apparatus as defined in claim 9, wherein:

the generator means comprises a first toroidal wire winding positioned within a conductive portion of the landing receptacle means; and the receiver means comprises a second toroidal wire winding positioned within a conductive portion of the latch tool means.

12. The apparatus as defined in claim 11, further comprising:

a first radially movable conductive interconnection means for establishing a mechanical and ohmic electrical path between the conductive portion of the landing receptacle means and the conductive portion of the latch tool means; and a second radially movable conductive interconnection between the conductive portion of the latch tool means and the conductive portion of the landing receptacle means;

such that a current loop is formed between the conductive portion of the landing receptacle means, the first conductor interconnection means, the conductive portion of the latch tool means, and the second conductor interconnection means.

13. The apparatus as defined in claim 12, further comprising:

a first electrically conductive radially flexible cage positioned on the test string and electrically connected to the conductive portion of the landing receptacle for engagement with the first conductive interconnection means;

a second electrically conductive radially flexible cage positioned on the test string and electrically connected to the conductive portion of the landing receptacle for engagement with the second conductive interconnection means; and the first and second metallic interconnection means are carried into the well on the latch tool means.

14. The apparatus as defined in claim 13, further comprising:

electrically powered drive means carried by the wireline for moving the first and second conductive interconnection means into electrical contact with the first and second cages, respectively.

15. A method of monitoring well fluid characteristics during a subterranean well bore in fluid communication with a formation of interest, the tubular string including a central passageway for lowering wireline tools to a selected depth via a conductive wireline, the method comprising:

lowering a latch tool having a receiver by the wireline to a selected position within the central passageway of the tubular string;

temporarily latching the latch tool in a fixed axial position on the tubular string with said receiver in ohmic isolation from said string;

sensing well fluid characteristics from a sensor positioned on the tubular string and generating a first signal functionally related to a sensed characteristic;

generating a second signal in the well bore having a characteristic functionally related to the first signal;

inducing a fluctuating electromagnetic field with a downhole electrical conductive portion of the tubular string in response to the second signal;

generating a third signal within the latch tool induced by the fluctuating electromagnetic field and having a characteristic proportional thereto;

conditioning the third signal for transmission to the surface via the conductor wireline; and processing the conditioned signal at the surface in real time.

16. The method as defined in claim 15, further comprising:

providing a landing receptacle on the tubular string for latching engagement with the latch tool; and providing a fluid pressure passageway in the tubular string isolated from the central passageway of the tubular string for establishing pressure communication between the central passageway and the sensor.

17. The method as defined in claim 15, further comprising:

radially moving outward a first conductive interconnection in the well bore for establishing a mechanical and ohmic electrical path between the conductive portion of the tubular string and a conductive portion of the latch tool; and radially moving outward a second conductive interconnection in the well bore for establishing a mechanical and ohmic electrical path between the conductive portion of the latch tool and the conductive portion of the tubular string;

such that a current loop is formed between the conductive portion of the tubular string, the first conductive interconnection, the conductive portion of the latch tool, and the second conductive interconnection.

18. The method as defined in claim 17, further comprising:

actuating an electrically powered drive in the latch tool for radially moving the first and second conductive interconnections into electrical engagement with both the metallic portion of the latch tool and the conductive portion of the tubular string.

19. The method as defined in claim 16, further comprising:

providing a test valve on the tubular string for selectively opening and closing the central passageway of the tubular string; and providing a fluid flow passageway radially outward of the fluctuating electromagnetic field for flow of fluid from the well bore to the central passageway of the tubular string above the latch tool when the latch tool is fixed on the tubular string and the test valve is open.

20. The method as defined in claim 15, further comprising:

providing an operator readable printout of the well fluid characteristics in real time; and controlling downhole equipment operations by transmitting control signals through the wireline in response to the printout.

21. The apparatus as defined in claim 1, wherein said generating means includes a core carried in said test string, said core having wrapped thereabout a plurality of wire windings electrically connected to said converter means.

22. The apparatus as defined in claim 21, wherein said core includes a toroidal member positioned about said latch tool means.

23. The apparatus as defined in claim 1, wherein said receiver means includes a core carried by said latch tool means, said core having wrapped thereabout a plurality of wire windings electrically connected to said signal conditioning means.

24. Apparatus for monitoring well fluid characteristics during a subterranean well test utilizing a test string positioned in a subterranean well bore in fluid communication with a formation of interest, the test string including a central passageway for lowering wireline tools to a selected test spring depth via a conductor wireline, the apparatus comprising:

a test valve positioned on the test string;

a sensor means positioned on the test string for sensing well fluid characteristics below the test valve and generating a first signal functionally related to a sensed characteristic;

a landing receptacle means positioned on the test string axially above the test valve;

converter means positioned on the test string for generating a second AC signal having a characteristic functionally related to the first signal;

generating means including a magnetic member electrically connected to said convertor means positioned on the test string for inducing a fluctuating electromagnetic field within an electrically conductive portion of the landing receptacle means adjacent the generator means in response to the second AC signal;

latch tool means carried by the wireline and positionable within the central passageway of the test string for temporarily latching in a fixed axial position on the landing receptacle;

receiver means including a magnetic member carried by the latch tool means adjacent an electrically conductive portion of the latch tool means and spaced radially inward of and in ohmic isolation from the generating means when said latch tool means is temporarily latched in said landing receptacle means for providing a third signal induced by the fluctuating electromagnetic field and having a characteristic proportional thereto; and, signal conditioning means carried by the wireline for amplifying and converting the third signal for transmission to the surface via the electric wireline.

25. Apparatus for generating downhole data from sensors fixedly positioned on a tubular string in a subterranean well bore, the tubular string including a central passageway for lowering wireline tools to a selected depth via a conductor wireline, the apparatus comprising:

sensor means positioned on the tubular string for sensing downhole characteristics and generating a first signal functionally related to a sensed characteristic;

landing receptacle means positioned on the tubular string;

generator means including magnetic member positioned on the tubular string for inducing a fluctuating electromagnetic field in response to the first signal;

latch tool means carried by the wireline and positionable within the central passageway of the tubular string for temporarily latching in a fixed axial position on the landing receptacle means;

receiver means including a magnetic member carried by the wireline means positioned in ohmic isolation from said generator means when said latch tool means is temporarily latched in said landing receptacle means for producing a second signal induced by the fluctuating electromagnetic field and having a characteristic proportional thereto; and signal conditioning means carried by the wireline for amplifying and converting the second signal for transmission to the surface computing equipment via the conductor wireline.

* * * * *